US009785165B2

(12) United States Patent
Petenyi et al.

(10) Patent No.: US 9,785,165 B2
(45) Date of Patent: Oct. 10, 2017

(54) VOLTAGE REGULATOR WITH IMPROVED LINE REGULATION TRANSIENT RESPONSE

(71) Applicants: STMicroelectronics Design and Application S.R.O., Prague (CZ); STMicroelectronics S.r.l., Agrate Brianza (IT)

(72) Inventors: Sandor Petenyi, Milovice Nad Labem (CZ); Calogero Ribellino, Mascalucia (IT)

(73) Assignees: STMicroelectronics Design and Application S.R.O., Prague (CZ); STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 15/014,320

(22) Filed: Feb. 3, 2016

(65) Prior Publication Data

US 2017/0220058 A1 Aug. 3, 2017

(51) Int. Cl.
*G05F 1/575* (2006.01)

(52) U.S. Cl.
CPC ..... *G05F 1/575* (2013.01)

(58) Field of Classification Search
CPC . G05F 1/56; G05F 1/575; G05F 1/468; G05F 1/562; G05F 1/565; G05F 1/595; H02M 3/156; H02M 3/158; H02M 3/157; H02M 3/1563
USPC ..... 323/270, 273, 274, 275, 279, 282, 283, 323/284, 280
See application file for complete search history.

(56) References Cited

U.S. PATENT DOCUMENTS 6,188,212 B1 * 2/2001 Larson ..... G05F 1/56 323/274
2003/0147193 A1 * 8/2003 Hamon ..... G05F 1/573 361/87
2010/0052635 A1 * 3/2010 Wang ..... G05F 1/575 323/280
2011/0254521 A1 * 10/2011 Iacob ..... G05F 1/56 323/282
2013/0076252 A1 * 3/2013 Shao ..... H05B 33/0824 315/186
2014/0292301 A1 * 10/2014 Lee ..... H03B 5/1228 323/299
2015/0220096 A1 * 8/2015 Luff ..... G02F 1/1368 327/109
2016/0085250 A1 * 3/2016 Luo ..... G05F 1/468 323/281

* cited by examiner

*Primary Examiner* — Adolf Berhane
(74) *Attorney, Agent, or Firm* — Gardere Wynne Sewell LLP

(57) ABSTRACT

A significant reduction of the amplitude of the transient response is obtained by keeping a low dropout regulator circuit in a closed loop condition. This is achieved by manipulation of the reference voltage level when an open loop condition arises due to a falling input voltage. In this case, the reference voltage level is tracked with the input voltage level, keeping the output voltage regulated. As a consequence, the power pass element of the regulator is not forced into the linear region (in the case of a MOSFET) or deep saturation (in the case of a bipolar transistor).

26 Claims, 6 Drawing Sheets

VOLTAGE REGULATOR WITH IMPROVED LINE REGULATION TRANSIENT RESPONSE

TECHNICAL FIELD

The present invention relates to voltage regulator circuits.

BACKGROUND

Voltage regulators such as low dropout (LDO) voltage regulators are widely used devices in electronic systems. Such circuits are usually applied in the voltage supply chain to provide a precise and time-stable supply voltage to the supplied system. There exist strong requirements on the electrical characteristics of regulator circuits. The main task for the voltage regulator is to keep the output voltage (VOUT) regulated at a nominal voltage level. This must be assured in both steady state and transient conditions. If the voltage VOUT goes out of regulation, this can lead to malfunction or even destruction of the supplied system. If the input voltage VIN of the LDO regulator changes over a wide range with a high slew rate, the output voltage VOUT can show different transient response products—for example, overshoots, undershoots. The amplitude of such transient response products depends on the regulator dynamic characteristics. This behavior is usually called the line transient response. It is beneficial to improve the operating characteristic because this will increase the overall regulator capability of keeping the output voltage VOUT constant.

LDO voltage regulators are usually built as feedback regulation systems. The circuit senses an error between the output voltage VOUT and a reference voltage (VREF), and after sufficient multiplication of the error the circuit drives a power pass (transistor) element with an amplified signal. From principle there is always some error between the VOUT and VREF, but because of high gain, the impact on the output voltage VOUT is negligible. Usually the precision of the output voltage VOUT level is impacted much more by an offset of the error amplifier and by the precision of the voltage reference. In steady state, when a supply voltage (VIN) level and the load current (ILOAD) are fixed, the regulator is able to provide a stable output voltage VOUT level. The situation is more problematic when VIN and/or ILOAD are changing, in particular when the change is very fast (for example, due to a transient condition). The LDO regulator as a real electronic circuit has a characteristic response time given by the charge stored inside the system and by the mobility of the charge carriers. For this reason the system is not able to react in an infinitely short time. This is represented as the line/load transient response of the LDO which can be seen on the VOUT waveform as under/over shoots around the nominal VOUT level. The amplitude of the transient response depends on the amplitude of the VIN, the ILOAD stimuli and the slew rate. Small and slow changes may generate relatively small VOUT transients; fast changes with high amplitude may generate relatively large VOUT transients (which may exceed safe limits).

The LDO regulator is known to operate in two conditions depending on the VIN level. If the VIN level is sufficiently in excess of the nominal VOUT voltage, the LDO regulator operates to regulate VOUT at a constant level. If the VIN level drops close to or even below the nominal VOUT voltage, however, the LDO regulator is not able to provide a constant VOUT level and the output voltage drops down. The first condition is referred to in the art as "closed loop" and the second condition is referred to as "open loop." In the open loop condition, the LDO regulator is not operating as a voltage regulator, per se, but rather behaves like a switch with some characteristic resistance causing some minimum dropout voltage VDROP=VIN−VOUT=ILOAD*RDSON (wherein RDSON is the on-resistance of the drive transistor). The transition between the closed loop condition and the open loop condition is represented by a significant change of operating points inside the LDO circuitry. If the change between the modes is due, for example, to an extreme and very fast VIN change, the circuit will accommodate this change over a short time period and the consequence of this effect is an extreme transient response overshoot and/or undershoot on the output voltage.

The dropout condition itself is not problematic for the LDO regulator, but the transition from the dropout (open loop) to the closed loop condition is. The transition is usually forced by a rising transition of the VIN level. The regulator has to react in a fast way to recover the VOUT regulation. Because there are significant charges stored inside the circuit, it is not possible to recover the regulation in an infinitely short time. The result of this can be a severe overshoot on the regulator output. There is a need in the art to improve significantly this response.

Reference is now made to FIG. 1 showing a conventional voltage regulator circuit 10 of the low drop out (LDO) type. The circuit 10 is of a known configuration including a bandgap voltage reference V1 generator, a LDO OPAMP I1, a power pass (P-channel MOSFET transistor) element M1, a feedback network (RX and R2), and an output storage capacitor COUT. The circuit 10 operates to provide a constant VOUT level, independent of the input voltage VIN level which can usually change over a wide range. The circuit represents a feedback system, driven by an error voltage VERR=VFB−VREF (where VFB is the feedback voltage provided by the resistive divider RX and R2). The error voltage VERR is amplified by the OPAMP M1 and a resulting driving voltage (VGATE) is applied to the gate of the power MOSFET M1. If the error voltage VERR is low, the output voltage VOUT is close to the nominal level and the feedback loop is closed. This condition is achieved when VIN is sufficiently high with respect to the nominal VOUT level and ILOAD. In this condition the operating point of the circuit nodes is set to a normal level and it changes only slightly depending on external conditions (for example, ILOAD, VIN and temperature). However, if the input voltage VIN drops too much such that the LDO regulator is not able to keep the output voltage VOUT constant, the feedback loop goes into the open loop (dropout) condition. Because the error voltage VERR in this case rises too high, the OPAMP generates the voltage VGATE to try to open the power MOSFET as much as possible by overdriving its VGS (gate to source voltage). The VDROP level depends on the RDSON of the power MOSFET and the load current in accordance with the following equation:

$$VDROP=RDSON*ILOAD \quad (1)$$

Furthermore, in the dropout condition different nodes of the OPAMP internal structure are pushed into a saturation state. If a fast rising VIN transition subsequently occurs in this condition, forcing the structure from the open loop to the closed loop condition, the circuit structure can have difficulty in discharging the power MOSFET VGS and recovering the normal regulating state of the OPAMP. This is usually accompanied by overshoot on the output voltage VOUT.

SUMMARY

A voltage regulator can work in two different operating modes: closed loop and open loop. Usually the regulator is designed to operate in the closed loop condition, keeping the output voltage regulated. In many applications, however, this condition is not always maintained and the regulator can pass from closed loop to the open loop condition when the supply voltage drops close to or below the LDO output regulated voltage. In this condition, the power MOSFET is fully turned on and the regulator loses all rejection performance. This is represented by significant operating point changes inside the regulator circuit. Because there are components inside the circuit storing significant charge (i.e., the power MOSFET is fully turned on with maximum allowed VGS), it is not possible to make this change in a short time. As a consequence the standard voltage regulator generates significant over/undershoots (spikes) during the transition from closed loop to open loop and vice versa.

Embodiments disclosed herein reduce significantly such spikes by keeping the regulator always in the closed loop condition. This is accomplished by altering the reference voltage of the regulator when the supply level is falling so as to cause the output voltage to drop below the nominal level. In this condition, the reference level tracks with the falling supply level. As a consequence, the minimum difference between supply and the output voltage (the dropout voltage) is not given by the power pass element characteristic but is instead an internally predefined difference between the supply level and the reference level. This difference can be made load current dependent for achieving characteristic similar to a standard voltage regulator.

The drawbacks of the prior art are addressed by reducing the line transient response of the LDO regulator. This accomplished by manipulation of the reference voltage VREF level when the device is in dropout condition. The manipulation is done with the goal of keeping the regulation loop inside the closed loop condition. If the closed loop condition is maintained the changes of the potentials are reduced and it is not necessary to move significant charge inside the circuit during the input voltage VIN transitions.

To improve the line regulation transient response, but also to maintain the standard dropout characteristic of the LDO regulator, the VREF manipulation is driven by both VIN and ILOAD. In particular, in the dropout condition the VREF level is tracked with the VIN level whereas the voltage difference between VIN and VOUT (VDROP) is ILOAD dependent. In normal closed loop condition the VREF level is kept constant, independent of any external variable.

If the input voltage VIN drops, forcing the regulator into the dropout condition, the VREF level is forced down to maintain the regulation. So, the VREF is tracked with the VIN level when necessary. The voltage difference between VIN and VREF level defines the VDROP, because if the regulation is maintained, the VREF is equal to VOUT.

For achieving a dropout characteristic similar to the standard LDO regulator, where the power MOSFET behaves like a resistor, the voltage difference between VIN and VREF is made load current dependent.

Generally speaking, the solution herein allows for a significant reduction of the amplitude of the transient response by keeping the LDO circuits in the closed loop condition. This is achieved by manipulation of the VREF level when an open loop condition due to falling input voltage VIN should occur. In this case, the VREF level is tracked with the VIN level, keeping the output voltage VOUT regulated. As a consequence, the power pass element is not forced into the linear region (in the case of a MOSFET) or deep saturation (in the case of a bipolar transistor).

In an embodiment, a voltage regulator circuit comprises: an input node configured to receive an input voltage; a power transistor having a conduction path coupled between the input node and an output node; an amplifier having an output driving a control terminal of the power transistor and a first input coupled to the output node to form a regulator feedback loop, said amplifier further having a second input; and a voltage generator supplied by the input voltage and configured to generate a variable reference voltage applied to the second input of the amplifier, said variable reference voltage varying correspondingly with changes in the input voltage.

In an embodiment, a voltage regulator circuit comprises: an input node configured to receive an input voltage; a power transistor having a conduction path coupled between the input node and an output node; a current sensing circuit configured to sense current flowing in the conduction path of the power transistor and generate a sense current; an amplifier having an output driving a control terminal of the power transistor and a first input coupled to the output node to form a regulator feedback loop, said amplifier further having a second input; and a voltage generator supplied by the input voltage and configured to generate a variable reference voltage applied to the second input of the amplifier in response to said input voltage and the sense current.

In an embodiment, a method for operating a voltage regulator circuit comprises: determining an error between a feedback voltage and a reference voltage; driving a control terminal of a power transistor with a control voltage derived from the determined error to generate an output voltage, wherein said feedback voltage is derived from the output voltage; supplying an input voltage to the power transistor; and generating said reference voltage to vary correspondingly with changes in the input voltage.

In an embodiment, a method for operating a voltage regulator circuit comprises: determining an error between a feedback voltage and a reference voltage; driving a control terminal of a power transistor with a control voltage derived from the determined error to generate an output voltage, wherein said feedback voltage is derived from the output voltage; sensing a current flowing through the power transistor; and varying the reference voltage in response to change in the sensed current.

BRIEF DESCRIPTION OF THE DRAWINGS

For a better understanding, preferred embodiments thereof are now described, purely by way of non-limiting example, with reference to the attached drawings, wherein.

DETAILED DESCRIPTION

Figure 2:
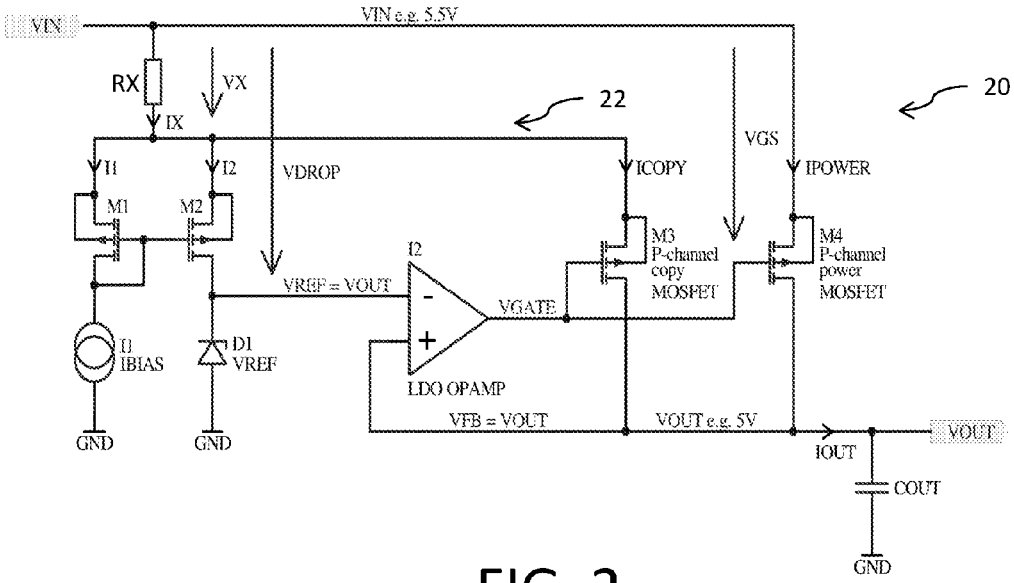
FIG. 2 is a circuit diagram for a voltage regulator circuit of the LDO type with a dropout control loop.

Reference is now made to FIG. 2 showing a voltage regulator circuit 20 of the LDO type with a dropout control loop 22. The circuit 20 includes a reference voltage VREF generator, an OPAMP I2 and a power pass (transistor) element M4. The reference voltage VREF generator is formed by current source I1, transistor M1, transistor M2, zener diode D1 and resistor RX. Transistor M1 is in a diode-connected configuration in series with current source I1. Transistor M2 is connected to transistor M1 in a current mirroring configuration and further connected at its drain to zener diode Z1 and the inverting input of the OPAMP (i.e., the source-drain or conduction path of transistor M2 is coupled to the non-inverting input of the OPAMP I1). To sense the LDO output current (IOUT), MOSFET M3 which is a scaled copy of transistor M4 is used (transistor M3 comprising a gate and drain connected to the gate and drain of the power MOSFET M4; the scaling ratio of M4:M3 may, for example, comprise 1000:1). The source of transistor M4 is connected to receive the input voltage VIN with the drain out transistor M4 coupled to the output node (i.e., the source-drain or conduction path of transistor M4 is coupled between the input node and output node). The source of transistor M3 is connected to the source terminals of transistors M1 and M2 and the drain of transistor M3 is coupled to output node (i.e., the source-drain or conduction path of transistor M3 is coupled between an intermediate node at the source terminals of transistors M1 and M2 and the output node). The transistor M3 accordingly generates a sense current ICOPY at the intermediate node according to the current IPOWER flowing through the transistor M4. The resistor RX is connected between VIN and the intermediate node at the source terminals of transistors M1 and M2. The drains of transistors M3 and M4 are connected to the output terminal and to the non-inverting input of the OPAMP I2 to form the feedback loop for regulation.

The LDO regulator 20 operates in two distinct conditions: a closed loop (regulation) condition and an open loop (dropout) condition. In the closed loop condition, the input voltage VIN is sufficiently high to guarantee a regulated output voltage VOUT. In the open loop condition, the input voltage VIN is lower than a certain limit and the LDO circuit 20 is not able to keep the output voltage VOUT at the nominal level. This circuit state represents the dropout condition, where the VOUT is tracked with the VIN. The difference between VIN and VOUT is referred to as the dropout voltage VDROP. More specifically:

$$VDROP > IOUT * RDSON_{M4} \quad (2)$$

This condition is a prerequisite for proper operation of circuit 20 and the production of an effective line transient response improvement.

The circuit 20 exhibits a difference in comparison to the circuit 10 of the prior art because the voltage VDROP is defined by the reference generator instead of the power MOSFET RDSON. The VDROP for circuit 20 can be expressed as:

$$VDROP = VDROP_{M2} + VX \quad (3)$$

wherein VX is the voltage drop across resistor RX and $VDROP_{M2}$ is the voltage drop across the transistor M2 representing the minimum VDS (voltage drain to source) of transistor M2 and is given by equation:

$$VDROP_{M2} = I2 * RDSON_{M2} \quad (4)$$

Figure 1:
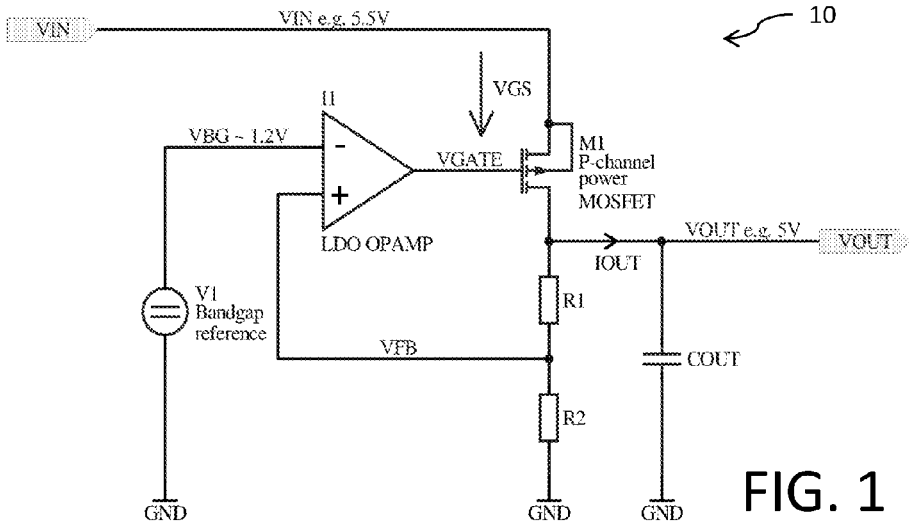
FIG. 1 (Prior Art)
FIG. 1 is a circuit diagram for a conventional voltage regulator circuit of the low drop out (LDO) type.

To make the dropout characteristic of circuit 20 similar to that of a standard LDO circuit like that shown in FIG. 1, the resistor RX is used in cooperation with the copy MOSFET M3 to form the dropout control loop 22. Because the current IX flowing through resistor RX changes with the IOUT current, the VX voltage will also follow the same trend:

$$VX = RX * (ICOPY + I1 + I2) \quad (5)$$

wherein the current I1 is the current though transistor M1 (i.e., the current of current source I1) and the current I2 is the current through transistor M2.

At significant load currents the contribution of the I1 and I2 currents can be neglected.

Then:

$$VX = RX * ICOPY \quad (6)$$

wherein the current ICOPY is the current through the copy transistor M3.

Combining above equations produces:

$$VDROP = (RX * ICOPY) + (I2 * RDSON_{M2}) \quad (7)$$

Figure 3:
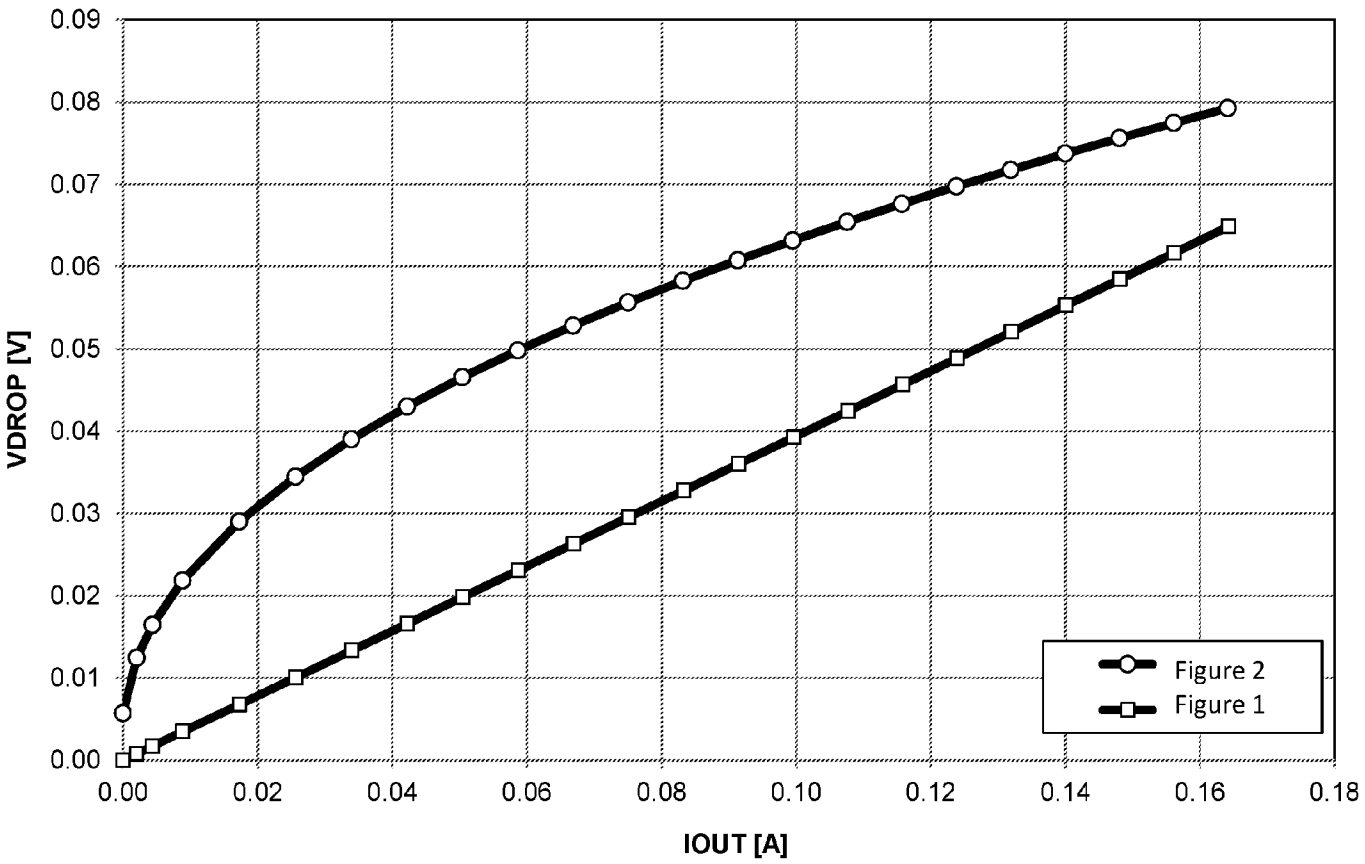
FIG. 3 illustrates the dropout voltage dependence on the load current for the circuits of FIGS. 1 and 2.

It will accordingly be noted from this equation that the voltage VDROP is a linear function of the ICOPY current. But for the overall LDO regulator, the VDROP dependence on the IPOWER current has a higher importance. It is not linear because the ratio between IPOWER and ICOPY is not linear, caused by a voltage drop on resistor RX. At low IPOWER currents the function is close to linear but at higher currents a square root content significantly impacts the ratio. This function is graphically shown in FIG. 3 which illustrates the dropout voltage dependence on the load current. The functions for both the prior art circuit 10 and the circuit 20 of FIG. 2 are shown for comparison purposes in FIG. 3. For the circuit 10, the dependence is linear because of the resistive nature of the power MOSFET channel in the linear region. In the circuit 20 of FIG. 2, however, the dropout curve is not given by the power MOSFET electrical characteristic, but is instead given by the control loop 22 influencing the reference voltage VREF level. The dropout characteristic of the circuit 20 exhibits a square root content because of the serial combination of the VGS of transistor M3 and the voltage VX. Because the feedback loop in circuit 20 is not interrupted in the dropout condition, the VOUT=VREF equality is maintained. For avoiding of the power MOSFET deep VGS overdrive, the dropout voltage of the circuit 20 is higher in comparison to the circuit 10 of FIG. 1.

Figure 4:
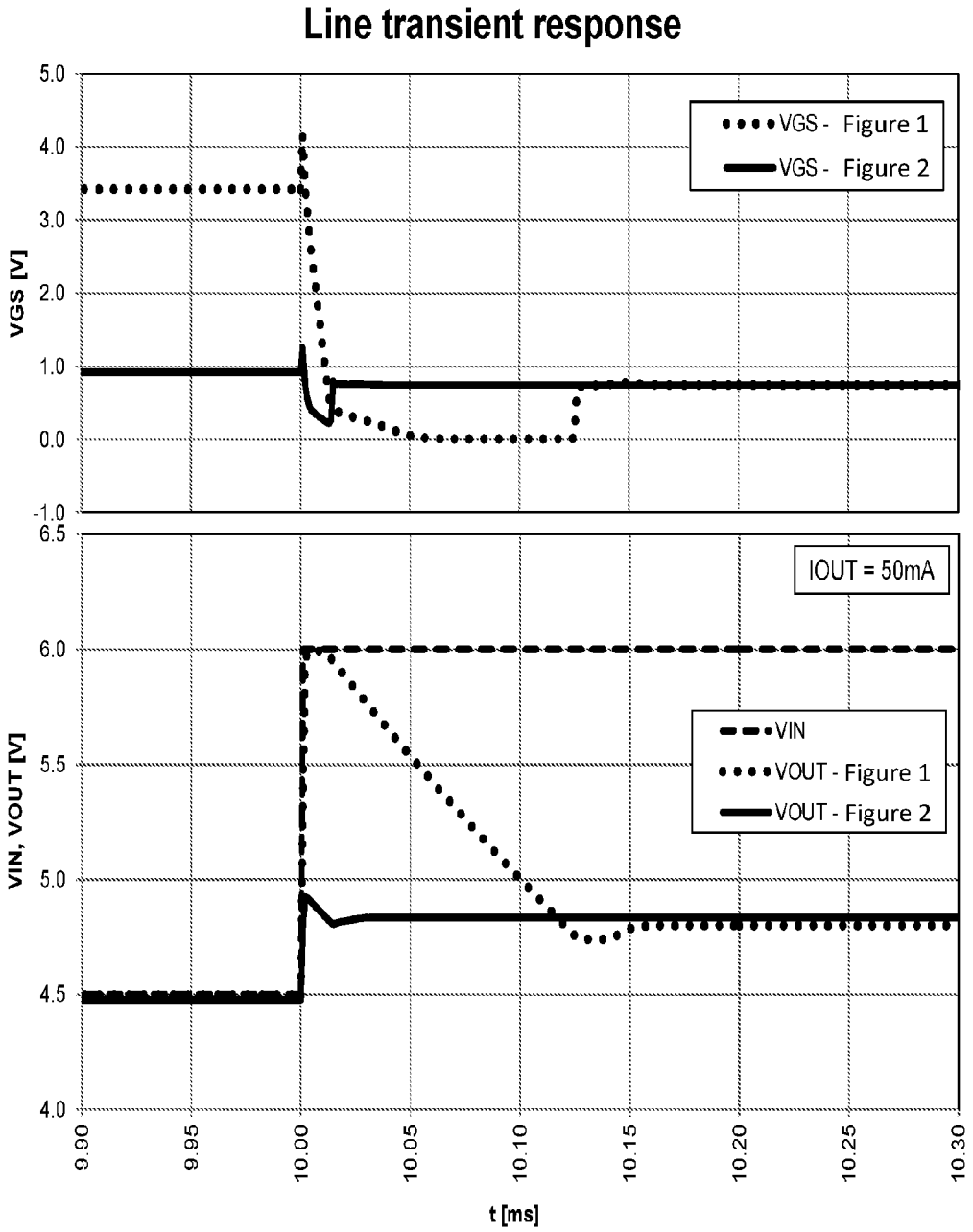
FIG. 4 illustrates a comparison between the line transient responses of the circuit of FIGS. 1 and 2.

The voltage VDROP defined by the VREF generator is set to be higher than the voltage VDROP defined by the power MOSFET M4 (equation 2). This assures that when VIN drops (forcing the LDO into the dropout condition) the OPAMP stays in the normal operating point for regulating the output voltage VOUT. When the input voltage VIN increase transition subsequently occurs, the OPAMP has no difficulty to keep the output voltage VOUT regulated without any significant overshoot. A comparison between the line transient responses of the circuit 10 of FIG. 1 and the circuit 20 of FIG. 2 is shown in FIG. 4, where VIN, VOUT and VGS (gate-to-source voltage of the power MOSFET) waveforms are plotted.

The input voltage VIN transient is chosen to drive the voltage regulator from open loop to closed loop condition. In the circuit 10 of FIG. 1, the VOUT response is represented by a large overshoot over the nominal regulated level. For the circuit 20 of FIG. 2, however, the overshoot amplitude is relatively small. From the waveforms of FIG. 4, the behavior of the power MOSFET VGS is evident. In the circuit 10 of FIG. 1, the power MOSFET is forced into the linear region with a high VGS overdrive. However, in the circuit 20 of FIG. 2, the power MOSFET is kept in the saturation region without the VGS overdrive.

At time 10 ms it will be noted that a fast input voltage VIN rising transient occurs. The reaction of the circuit 10 of FIG. 1 presents a severe overshoot on the output voltage VOUT because before the transient event the LDO regulator was in the open loop condition with VGS charged to almost 3.5V. The reaction of the circuit 20 of FIG. 2, however, presents a substantially smaller VOUT overshoot because the VGS before the event was kept at value below 1V and the OPAMP closed loop operating condition was maintained.

Figure 5:
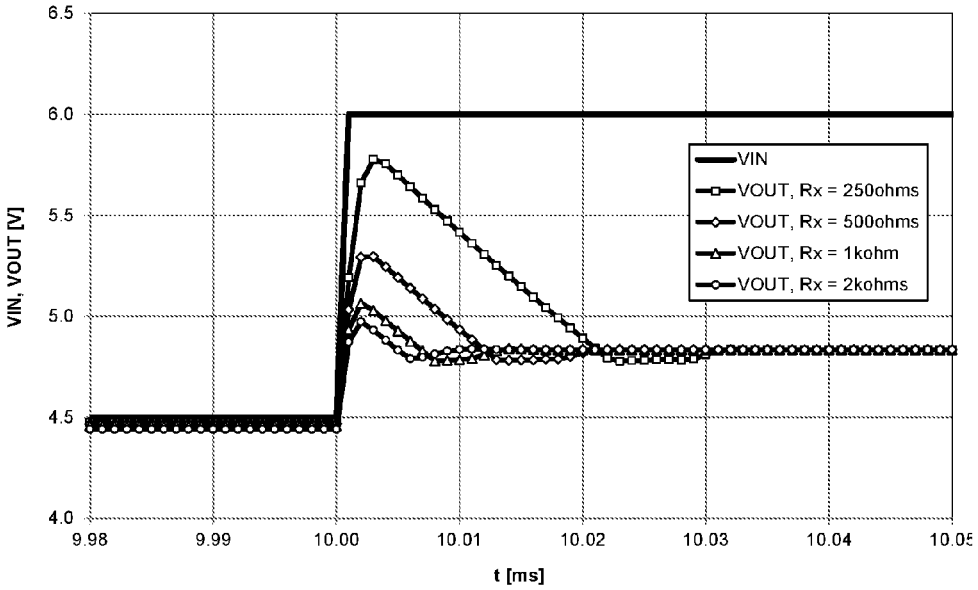
FIG. 5 illustrates VOUT behavior during the VIN rising transient (from dropout to regulation) for different values of the RX resistor in the circuit of FIG. 2.
Figure 6:
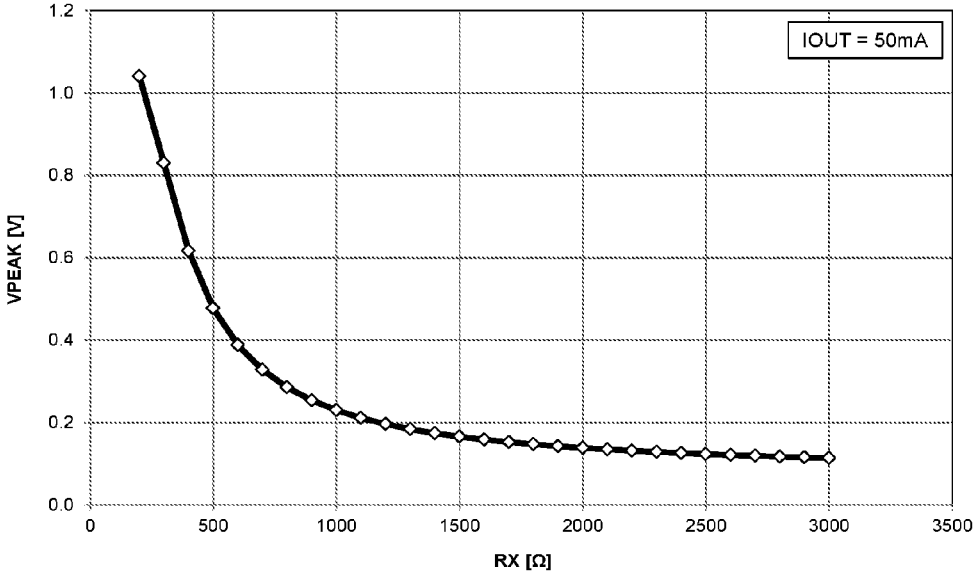
FIG. 6 plots the amplitude of the VOUT overshoot different values of the RX resistor in the circuit of FIG. 2.

Reference is now made to FIG. 5 showing the VOUT behavior during the VIN rising transient (from dropout to regulation) for different values of the RX resistor. It will be noted that relatively higher values of resistance for the resistor RX give lower amplitudes of the VOUT overshoot. The amplitude of the VOUT overshoot is analyzed in the plot on FIG. 6. The dependence can be approximated by a 1/x function. An optimal resistance value for the resistor RX can be selected by the circuit designer as a tradeoff between the VOUT overshoot and the VDROP voltage.

Figure 7:
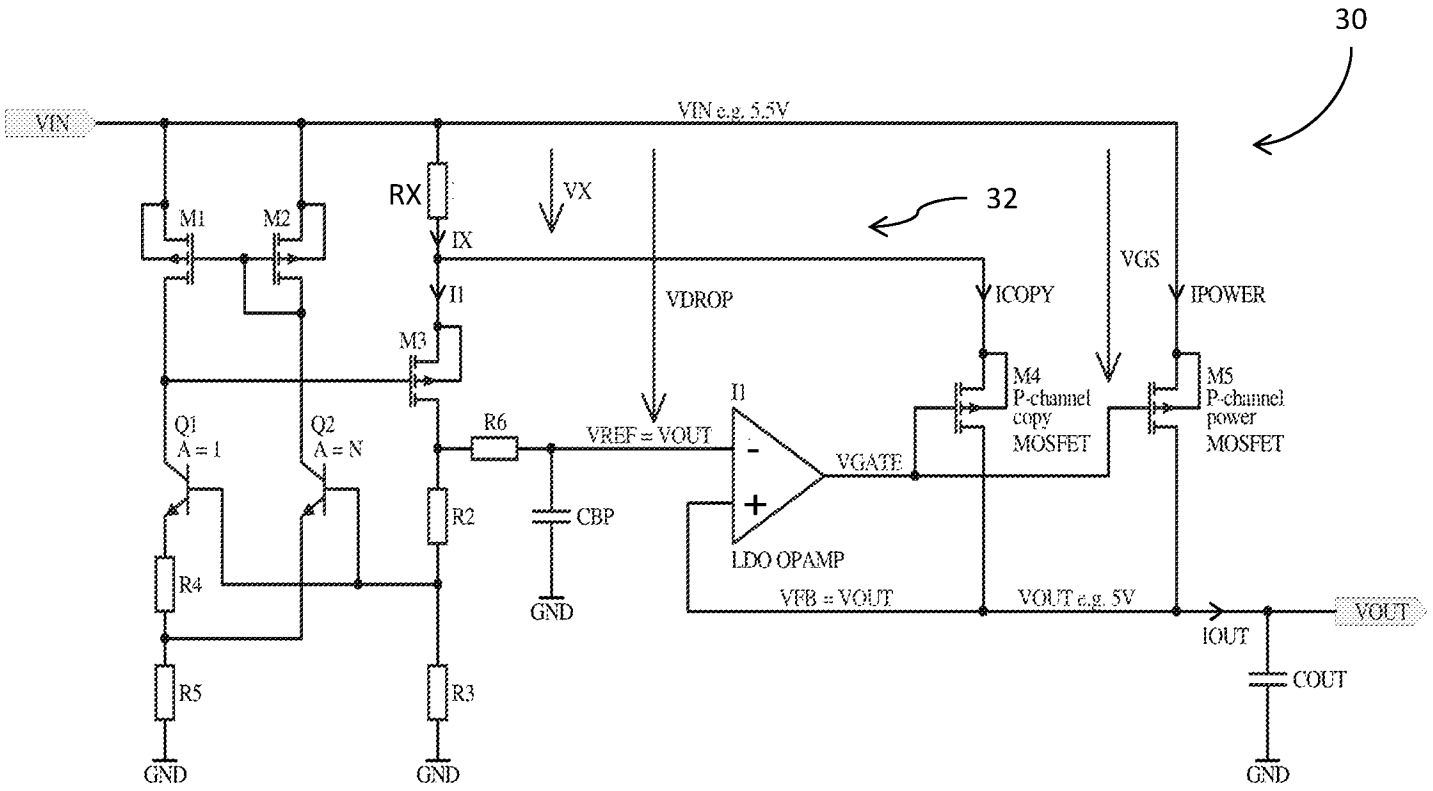
FIG. 7 is a circuit diagram for a voltage regulator circuit of the LDO type with a dropout control loop.

Reference is now made to FIG. 7 showing a voltage regulator circuit 30 of the LDO type with a dropout control loop 32. The circuit 30 includes a reference voltage VREF generator, an OPAMP I1 and a power pass (transistor) element M5. The reference voltage VREF generator is formed by transistor M1, transistor M2, transistor M3, transistor Q1, transistor Q2 and resistors R2-R6. Transistor M2 is in a diode-connected configuration in series with transistor Q2. Transistor M1 is connected to transistor M2 in a current mirroring configuration and is further connected to transistor Q1. Transistors Q1 and Q2 share a common base electrode connection to a resistive voltage divider formed by resistors R2 and R3. The emitter of transistor Q1 is coupled to a reference voltage node (GND) through series connected resistors R4 and R5. The emitter of transistor Q2 is connected the series connection node between resistors R4 and R5. The transistor M3 has a gate connection to the series connection node between transistors M1 and Q1. A drain of transistor M3 is connected to the resistive voltage divider formed by resistors R2 and R3. A resistor RX is coupled between the input voltage VIN and the source of transistor M3.

To sense the LDO output current (IOUT), MOSFET M4 which is a copy of transistor M5 is used (transistor M4 comprising a gate and drain connected to the gate and drain of the power MOSFET M5; the scaling ratio of M5:M4 may, for example, comprise 1000:1). The source of transistor M5 is connected to receive the input voltage VIN. The source of transistor M4 is connected to the source terminal of transistor M3 at resistor RX. The drains of transistors M3 and M4 are connected to the output terminal and to the non-inverting input of the OPAMPL I1 to form the feedback loop for regulation. The resistor R6 is coupled between the drain of transistor M3 and the inverting input of the OPAMP I1.

The circuit components Q1, Q2, M1, M2, M3, R4, R5, R2, R3 and RX form a bandgap reference voltage generator have a circuit configuration and operation that is well known to those skilled in the art. The resistor R6 and shunt capacitor CBP form a low pass filter circuit which helps to reduce possible glitches, improve supply voltage rejection and reduce noise. The remainder of the circuit 30 corresponds to the circuit 20 of FIG. 2. The function of resistor RX together with the copy MOSFET M4 (forming the dropout control loop 32) is the same as with loop 22 in the circuit 20 of FIG. 2. The bandgap reference voltage generator is equipped with a feedback network formed by the resistive voltage divider R2 and R3 that guarantees natural bandgap voltage multiplication to the required VREF level. Also in this circuit 30 the VOUT=VREF equality is always maintained by the regulation loop formed by OPAMP I1 and the power MOSFET M5.

In order to achieve the expected line transient response in the circuit 30, it is necessary to design the bandgap generator to have a fast line transient response. The circuit designer must take in account the fact that the bandgap generator can pass to open loop condition when VIN is not sufficient to guarantee regulation of the reference voltage VREF. In this dropout condition the VGS of the bandgap pass element M3 is overdriven to a maximum possible value. But guaranteeing a fast recovery of the bandgap reference is much easier than guaranteeing a fast recovery for the OPAMP I1 and the large power MOSFET M5. This is because the charge stored in relatively smaller bandgap reference components is much less than the charge stored in the OPAMP I1 and the power MOSFET M5. For this reason, the main feedback loop has to be always kept in regulation as was described above in connection with the circuit 20 of FIG. 2. For the circuit 30, the electrical characteristics shown in FIG. 3, FIG. 4, FIG. 5 and FIG. 6 relative to the circuit of FIG. 2 are equally valid.

Figure 8:
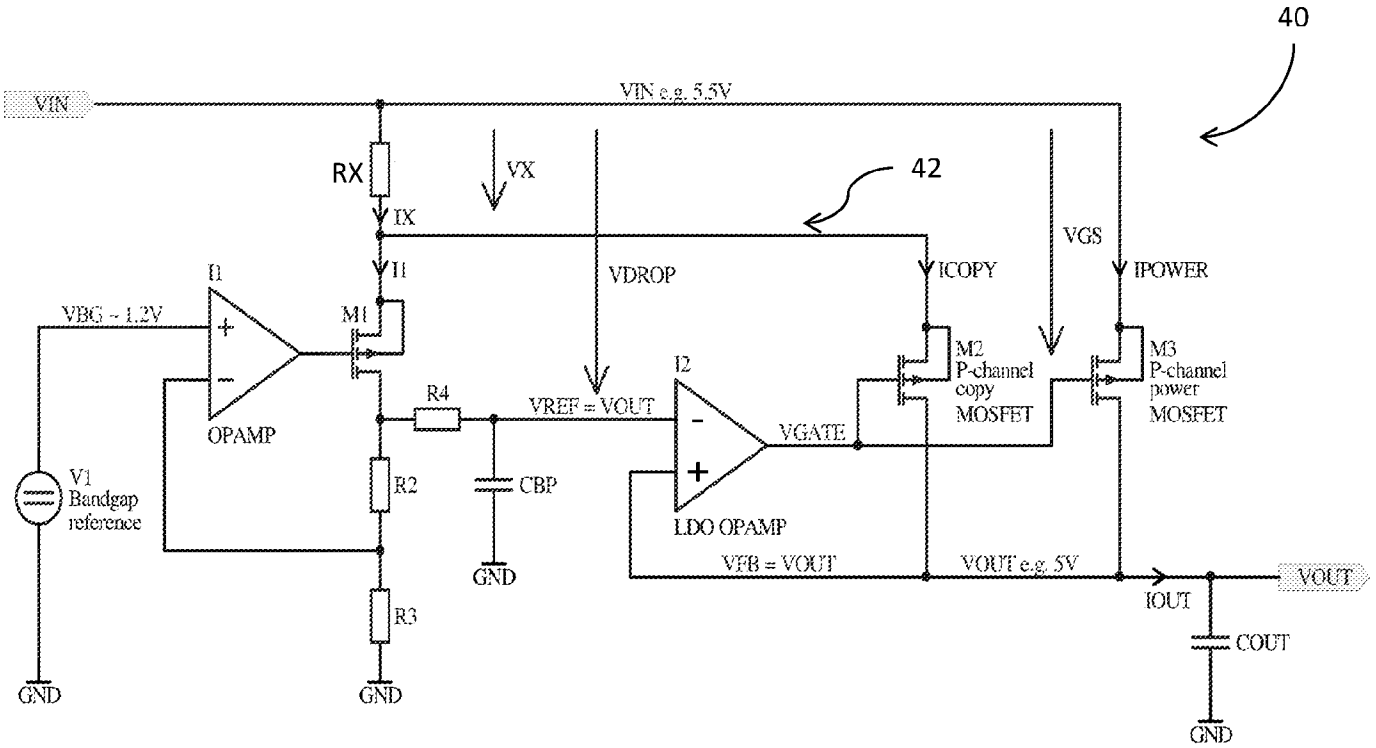
FIG. 8 is a circuit diagram for a voltage regulator circuit of the LDO type with a dropout control loop.

Reference is now made to FIG. 8 showing a voltage regulator circuit 40 of the LDO type with a dropout control loop 42. The circuit 40 includes a reference voltage VREF generator, an OPAMP I2 and a power pass (transistor) element M3. The reference voltage VREF generator is formed by transistor M1, OPAMP I1 and resistors R2-R3. A bandgap reference voltage generator provides a bandgap voltage VBG. The reference voltage VREF is not provided directly from the bandgap voltage generator V1 (compare to FIG. 7), but rather is provided using a voltage multiplier circuit formed by OPAMP I1, MOSFET M1 and resistors RX, R2 and R3. The bandgap voltage is applied to a non-inverting input of the OPAMP I1. Transistor M1 has a gate terminal coupled to the output of the OPAMP I1. A resistive voltage divider formed by resistors R2/R3 is coupled between the drain of transistor M1 and a reference voltage node (GND). A series connection node between resistors R2 and R3 is coupled to the inverting input of the OPAMP To sense the LDO output current (IOUT), MOSFET M2 which is a copy of transistor M3 is used (transistor M2 comprising a gate and drain connected to the gate and drain of the power MOSFET M3; the scaling ratio of M3:M2 may, for example, comprise 1000:1). The source of transistor M3 is connected to receive the input voltage VIN. The source of transistor M2 is connected to the source terminal of transistor M1 at resistor RX. The drains of transistors M2 and M3 are connected to the output terminal and to the non-inverting input of the OPAMPL I2 to form the feedback loop for regulation. The resistor R4 is coupled between the drain of transistor M1 and the inverting input of the OPAMP I2. The resistor R4 and shunt capacitor CBP form a low pass filter circuit which helps to reduce possible glitches, improve supply voltage rejection and reduce noise.

The feedback loop of the LDO regulator is formed by OPAMP I2 and MOSFETs M2, M3 in the same configuration as with the circuits 20 and 30. The purpose of the VREF voltage multiplier circuit is to amplify the bandgap voltage VBG to the required reference voltage VREF level equal to the nominal VOUT level. The resistor RX functions in cooperation with the MOSFET M2 to form the dropout control loop 42 (like loops 22 and 32) which protects the feedback regulation loop (OPAMP I2 and MOSFET M3) from the open loop condition.

An excess drop of the input voltage VIN forces the LDO regulator into the dropout condition, but the reference voltage VREF will correspondingly drop sufficiently down to a level which will keep the main feedback loop in the regulation. In this operating condition, the VREF multiplier loop (OPAMP I1, MOSFET M1 and feedback divider R2, R3) transitions into the open loop condition. But because the size of components and corresponding charge stored is much smaller compared to the main feedback loop, the recovery from the open loop to closed loop condition is much faster. Possible glitches during the operation are filtered by the RC filter formed by resistor R4 and capacitor CBP. For the circuit 40, the electrical characteristics shown in FIG. 3, FIG. 4, FIG. 5 and FIG. 6 relative to the circuit of FIG. 2 are equally valid.

Although the regulator circuits are illustrated and described in connection with a MOSFET implementation, it will be understood that the disclosure is equally applicable to regulator circuits implemented in bipolar technology. Furthermore, the polarity of the transistor devices is by way of example only, it being understood that the circuits could alternatively be implemented with opposite polarity devices.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A voltage regulator circuit, comprising:

an input node configured to receive an input voltage;

a power transistor having a conduction path coupled between the input node and an output node;

an amplifier having an output driving a control terminal of the power transistor and a first input coupled to the output node to form a regulator feedback loop, said amplifier further having a second input; and a voltage generator supplied by the input voltage and configured to generate a variable reference voltage applied to the second input of the amplifier, said variable reference voltage varying correspondingly with changes in the input voltage.

2. The voltage regulator circuit of claim 1, further comprising:

a current sensing circuit configured to sense current flowing in the conduction path of the power transistor and generate a sense current at an intermediate node;

a first resistor coupled between the input node and the intermediate node; and a first transistor having a conduction path coupled between the intermediate node and the second input of the amplifier.

3. The voltage regulator circuit of claim 2, further comprising a low pass filter coupled between the first transistor and the second input of the amplifier.

4. The voltage regulator circuit of claim 2, further comprising a zener diode coupled between the first transistor and a reference voltage node.

5. The voltage regulator circuit of claim 4, wherein the reference voltage node is a ground node.

6. The voltage regulator circuit of claim 4, further comprising:

a second transistor coupled to the first transistor to form a current mirroring circuit; and a current source configured to supply a bias current to the second transistor.

7. The voltage regulator circuit of claim 2, further comprising a bandgap reference voltage generator including said first transistor.

8. The voltage regulator circuit of claim 7, wherein said bandgap reference voltage generator comprises:

a pair of MOSFET transistor coupled to the input node and configured in a current mirror relationship; and a pair of bipolar transistors respectively coupled in series with the pair of MOSFET transistors;

wherein a series connect node between one of the pair of MOSFET transistors and one of the pair of bipolar transistors is coupled to a control terminal of the first transistor.

9. The voltage regulator circuit of claim 8, wherein said bandgap reference voltage generator further comprises a resistive voltage divider circuit coupled between the first transistor and a reference voltage node, an output of the resistive voltage divider circuit coupled to control terminals of the pair of bipolar transistors.

10. The voltage regulator circuit of claim 9, wherein the reference voltage node is a ground node.

11. The voltage regulator circuit of claim 2, further comprising:

a bandgap reference voltage generator configured to generate a bandgap voltage;

a resistive voltage divider circuit coupled between the first transistor and a reference voltage node; and an additional amplifier having an output driving a control terminal of the first transistor, a first input coupled to an output of the resistive voltage divider to form a feedback loop and a second input coupled to receive said bandgap voltage.

12. The voltage regulator circuit of claim 2, wherein said current sensing circuit comprises a second transistor which is a scaled copy of the power transistor, said second transistor having a conduction path coupled between the intermediate node and the output node and having a control terminal coupled to the output of the amplifier.

13. A voltage regulator circuit, comprising:

an input node configured to receive an input voltage;

a power transistor having a conduction path coupled between the input node and an output node;

a current sensing circuit configured to sense current flowing in the conduction path of the power transistor and generate a sense current;

an amplifier having an output driving a control terminal of the power transistor and a first input coupled to the output node to form a regulator feedback loop, said amplifier further having a second input; and a voltage generator supplied by the input voltage and configured to generate a variable reference voltage applied to the second input of the amplifier in response to said input voltage and the sense current.

14. The voltage regulator circuit of claim 13, wherein the sense current is generated at an intermediate node, the voltage generator comprising:

a first resistor coupled between the input node and the intermediate node; and a first transistor having a conduction path coupled between the intermediate node and the second input of the amplifier.

15. The voltage regulator circuit of claim 14, further comprising:

a zener diode coupled between the first transistor and a reference voltage node;

a second transistor coupled to the first transistor to form a current mirroring circuit; and a current source configured to supply a bias current to the second transistor.

16. The voltage regulator circuit of claim 14, wherein the voltage generator circuit comprises a bandgap reference voltage generator including said first transistor.

17. The voltage regulator circuit of claim 14, further comprising:

a bandgap reference voltage generator configured to generate a bandgap voltage;

a resistive voltage divider circuit coupled between the first transistor and a reference voltage node; and an additional amplifier having an output driving a control terminal of the first transistor, a first input coupled to an output of the resistive voltage divider to form a feedback loop and a second input coupled to receive said bandgap voltage.

18. The voltage regulator circuit of claim 14, wherein said current sensing circuit comprises a second transistor which is a scaled copy of the power transistor, said second transistor having a conduction path coupled between the intermediate node and the output node and having a control terminal coupled to the output of the amplifier.

19. A method for operating a voltage regulator circuit, comprising:

determining an error between a feedback voltage and a reference voltage;

driving a control terminal of a power transistor with a control voltage derived from the determined error to regulate an output voltage, wherein said feedback voltage is derived from the output voltage;

supplying an input voltage to the power transistor; and decreasing said reference voltage correspondingly to a decrease in the input voltage so as to maintain the output voltage in regulation.

20. A method for operating a voltage regulator circuit, comprising:

determining an error between a feedback voltage and a reference voltage;

driving a control terminal of a power transistor with a control voltage derived from the determined error to regulate an output voltage, wherein said feedback voltage is derived from the output voltage;

generating a sense current corresponding to a current flowing through the power transistor; and decreasing the reference voltage in response to change in the sense current so as to maintain the output voltage in regulation.

21. The voltage regulator circuit of claim 1, wherein said variable reference voltage decreases in response to a decrease in the input voltage to a voltage level that will provide for a regulated voltage at said output node.

22. The voltage regulator circuit of claim 1, wherein said variable reference voltage decreases in response to a decrease in the input voltage to a voltage level preventing the voltage regulator circuit from dropping out of regulation.

23. The voltage regulator circuit of claim 1, wherein said variable reference voltage changes in response to changes in the input voltage so as to maintain the regulator feedback loop in a closed loop operating condition.

24. The voltage regulator circuit of claim 13, wherein said variable reference voltage decreases in response to change in the sense current and a decrease in the input voltage to a voltage level that will provide for a regulated voltage at said output node.

25. The voltage regulator circuit of claim 13, wherein said variable reference voltage decreases in response to change in the sense current and a decrease in the input voltage to a voltage level preventing the voltage regulator circuit from dropping out of regulation.

26. The voltage regulator circuit of claim 13, wherein said variable reference voltage changes in response to changes in the sense current and input voltage so as to maintain the regulator feedback loop in a closed loop operating condition.

* * * * *